US006263966B1

(12) United States Patent
Haut et al.

(10) Patent No.: US 6,263,966 B1
(45) Date of Patent: Jul. 24, 2001

(54) EXPANDABLE WELL SCREEN

(75) Inventors: Richard C. Haut, Houston, TX (US); Ian J. Mickelburgh, Buros (FR); Ronald G. Dusterhoft; Pat York, both of Katy, TX (US); Jackie LaFontaine, Spring, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/220,289

(22) Filed: Dec. 23, 1998

Related U.S. Application Data

(60) Provisional application No. 60/111,293, filed on Dec. 7, 1998, and provisional application No. 60/108,558, filed on Nov. 16, 1998.

(51) Int. Cl.[7] ..... E21B 43/08

(52) U.S. Cl. ..... 166/278; 166/230

(58) Field of Search ..... 166/206, 207, 166/313, 277, 227, 230, 278

(56) References Cited

U.S. PATENT DOCUMENTS

| | | | | |
|---|---|---|---|---|
| 1,500,829 | | 7/1924 | Layne . | |
| 1,880,218 | | 10/1932 | Simmons . | |
| 2,835,328 | * | 5/1958 | Thompson | 166/157 X |
| 2,933,137 | * | 4/1960 | D'Audiffret et al. | 166/227 X |
| 2,990,017 | * | 6/1961 | Powers | 166/157 |
| 3,028,915 | * | 4/1962 | Jennings | 166/277 |
| 3,167,122 | | 1/1965 | Lang . | |
| 3,179,168 | | 4/1965 | Vincent . | |
| 3,203,451 | * | 8/1965 | Vincent | 166/277 X |
| 3,203,483 | | 8/1965 | Vincent . | |
| 3,297,092 | | 1/1967 | Jennings . | |
| 3,353,599 | * | 11/1967 | Swift | 166/207 X |
| 3,477,506 | | 11/1969 | Malone . | |
| 3,502,145 | * | 3/1970 | Du Mee et al. | 166/227 |
| 5,083,608 | * | 1/1992 | Abdrakhmanov et al. | 166/207 X |
| 5,348,095 | | 9/1994 | Worrall et al. . | |
| 5,366,012 | | 11/1994 | Lohbeck . | |
| 5,404,954 | * | 4/1995 | Whitebay et al. | 166/369 |
| 5,667,011 | * | 9/1997 | Gill et al. | 166/207 X |
| 5,901,789 | * | 5/1999 | Donnelly et al. | 166/381 |
| 5,924,745 | | 7/1999 | Campbell . | |
| 5,984,568 | | 11/1999 | Lohbeck . | |
| 6,006,829 | | 12/1999 | Whitlock et al. . | |
| 6,012,522 | * | 1/2000 | Donnelly et al. | 166/207 X |
| 6,012,523 | | 1/2000 | Campbell et al. . | |
| 6,021,850 | | 2/2000 | Wood et al. . | |
| 6,029,748 | | 2/2000 | Forsyth et al. . | |
| 6,044,906 | | 4/2000 | Saltel . | |

FOREIGN PATENT DOCUMENTS

| | | |
|---|---|---|
| 0674095A2 | 9/1995 | (EP) . |
| 0643794B1 | 11/1996 | (EP) . |

(List continued on next page.)

OTHER PUBLICATIONS

Weatherford Completion Systems Expandable Sand Screen, undated.

Enventure Expandable—Tubular Technology Brochure, dated 1998.

(List continued on next page.)

*Primary Examiner*—David Bagnell
*Assistant Examiner*—John Kreck
(74) *Attorney, Agent, or Firm*—William M. Imwalle; Marlin R. Smith

(57) ABSTRACT

An improved expandable well screen and associated methods of servicing a subterranean well provide enhanced functionality, while increasing the convenience of manufacture and deployment of the screen, and reducing the screen's cost. In one described embodiment of the invention, an expandable well screen includes a pleated woven metal filter element disposed overlying a perforated base pipe. When the screen is appropriately positioned within a well, an expanding tool is utilized to radially enlarge the base pipe and filter element.

21 Claims, 3 Drawing Sheets

FOREIGN PATENT DOCUMENTS

| | | |
|---|---|---|
| 0643795B1 | 11/1996 | (EP) . |
| 0824628B1 | 12/1998 | (EP) . |
| 2336383 | 10/1999 | (EP) . |
| WO93/25799 | 12/1993 | (WO) . |
| WO96/22452 | 7/1996 | (WO) . |
| WO96/37680 | 11/1996 | (WO) . |
| WO96/37681 | 11/1996 | (WO) . |
| WO97/17526 | 5/1997 | (WO) . |
| WO97/17527 | 5/1997 | (WO) . |
| WO97/21901 | 6/1998 | (WO) . |
| WO98/26152 | 6/1998 | (WO) . |
| WO98/42947 | 10/1998 | (WO) . |
| WO99/23354 | 5/1999 | (WO) . |
| WO99/56000 | 11/1999 | (WO) . |

OTHER PUBLICATIONS

Petroline ESS Products: General Information Brochure, dated Nov. 1998.

Petroline Expandable Slotted Tube Products Brochure, undated.

Patent Application "Isolation of Subterranean Zones" Filed Nov. 16, 1998, Inventor Robert Lance Cook.

* cited by examiner

FIG.5
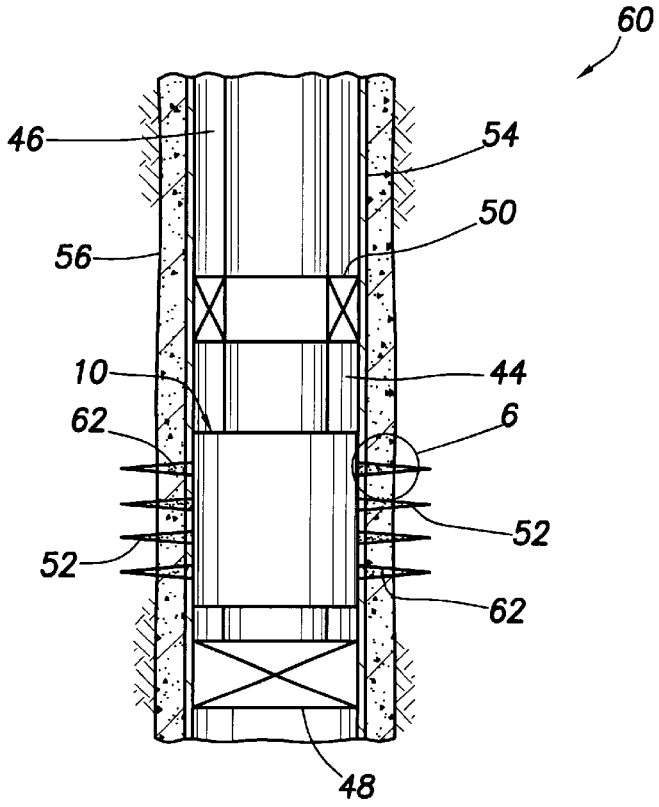
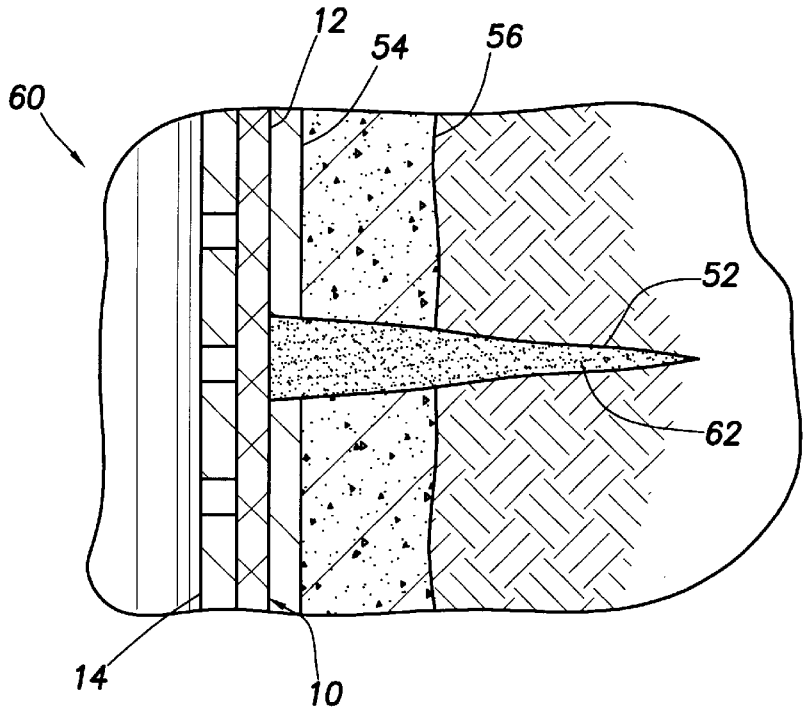
FIG.6

EXPANDABLE WELL SCREEN

CROSS-REFERENCE TO RELATED APPLICATIONS

This application is related to a provisional application entitled WELLBORE CASING U.S. Ser. No. 60/111,293, filed Dec. 7, 1998, and having Robert L. Cook, David Brisco, Bruce Stewart, Lev Ring, Richard Haut and Bob Mack as inventors thereof, and to a provisional application entitled ISOLATION OF SUBTERRANEAN ZONES U.S. Ser. No. 60/108,558, filed Nov. 16, 1998, and having Robert L. Cook as an inventor thereof, the disclosure of each of these applications being incorporated herein by this reference.

BACKGROUND OF THE INVENTION

The present invention relates generally to operations performed in conjunction with subterranean wells and, in an embodiment described herein, more particularly provides an improved expandable well screen for use in such operations.

It is well known in the art to convey a well screen into a subterranean well in a radially reduced configuration and then, after the screen has been appropriately positioned within the well, to radially expand the screen. Such expandable screens are beneficial where it is desired to position the screen below a restriction in the well, such as a restriction due to damaged casing, variations in open hole wellbore diameter, the need to pass the screen through a relatively small diameter tubular string before placing the screen in operation in a larger diameter tubular string or open hole, etc.

Presently available expandable well screens are constructed of multiple circumferentially distributed screen segments overlying an expandable inner tubular member. An outer shroud protects the screen segments against damage as the screen is being conveyed in the well, and ensures that each segment is appropriately positioned in contact with the inner tubular member and the adjacent segment, so that each segment is supported by the inner tubular member and no fluid leakage is permitted between adjacent segments, when the screen is expanded downhole. The inner tubular member has a large number of longitudinally extending slots formed therethrough, with the slots being circumferentially and longitudinally distributed on the tubular member. When the inner tubular member is expanded, each of the slots expands laterally, thereby becoming somewhat diamond-shaped.

Unfortunately, there are several problems associated with these types of expandable well screens. For example, manufacture is quite difficult due to the requirement of attaching individual screen segments to the inner tubular member in a circumferentially overlapping manner, and the requirement of positioning the segments within the outer shroud. Construction of the outer shroud is critical, since the shroud must be expandable yet sufficiently strong to maintain each screen segment in contact with an adjacent segment when the screen is expanded. If the screen segments are not in contact with each other, fluid may flow into the screen between the segments. Additionally, the inner tubular member configuration makes it difficult to connect the screen to other tubular members, such as blank sections of tubing, other screens, etc.

From the foregoing, it can be seen that it would be quite desirable to provide an improved expandable well screen. It is accordingly an object of the present invention to provide advancements in the technology of expandable well screens.

SUMMARY OF THE INVENTION

In carrying out the principles of the present invention, in accordance with an embodiment thereof, an expandable well screen is provided in which a filter element thereof is circumferentially pleated. The filter element may circumscribe an inner perforated base pipe. Associated methods are also provided.

In one aspect of the present invention, a disclosed well screen includes a filter element which is constructed in a radially compressed pleated configuration. The filter element may be made of a woven metal material. Subsequent radial expansion of the filter element "unpleats" the material, so that the filter element takes on a more circular cross-section.

In another aspect of the present invention, the filter element is constructed in multiple layers. An inner layer has openings therethrough of a size which excludes larger particles from passing through the openings, thus filtering fluid flowing through the openings. An outer layer has openings therethrough which are larger than the openings through the inner layer. The outer layer may be utilized to protect the inner layer against damage.

In still another aspect of the present invention, the well screen may be utilized in a method of servicing a subterranean well. In the method, the well is gravel packed with the screen in its radially compressed configuration. After gravel has been deposited in an annulus about the screen, the screen is radially enlarged, thereby displacing the gravel in the annulus.

In yet another aspect of the present invention, the well screen may be utilized in another method of servicing a subterranean well. In this method, perforations formed outwardly from the wellbore are pre-packed, that is, sand flow inhibiting particulate matter is deposited in the perforations. The screen is then radially enlarged opposite the perforations. In this manner, the screen retains the particulate matter in the perforations.

These and other features, advantages, benefits and objects of the present invention will become apparent to one of ordinary skill in the art upon careful consideration of the detailed description of representative embodiments of the invention hereinbelow and the accompanying drawings.

BRIEF DESCRIPTION OF THE DRAWINGS

FIG. 5 is a schematicized view of a second method of servicing a subterranean well, the method embodying principles of the present invention; and FIG. 6 is an enlarged view of a portion of the well of FIG. 5.

DETAILED DESCRIPTION

Figure 1:
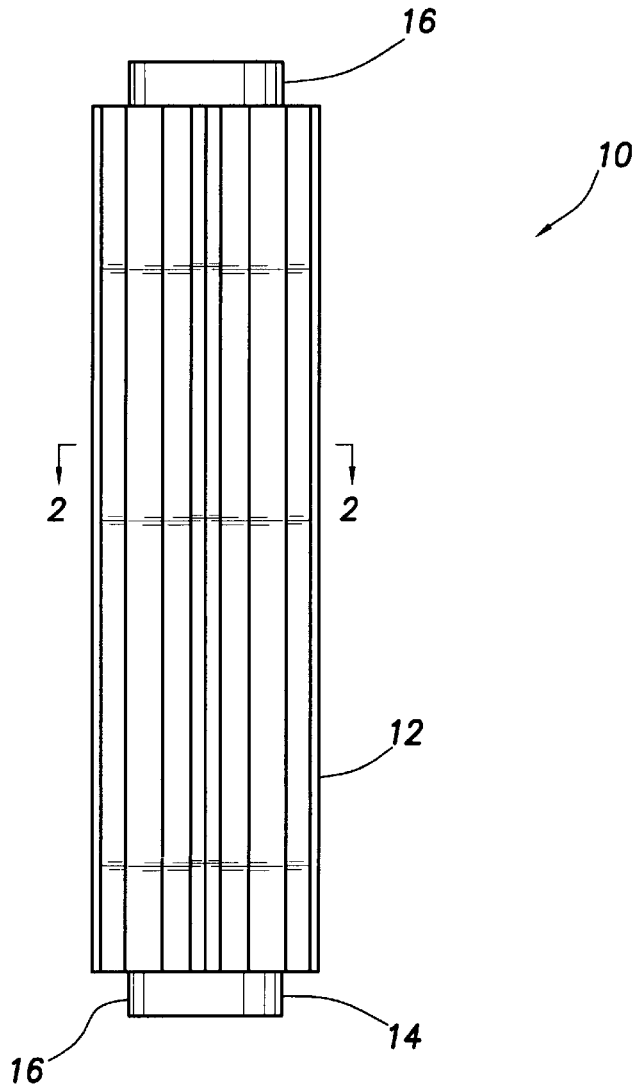
FIG. 1 is a side elevational view of a well screen embodying principles of the present invention.

Representatively illustrated in FIG. 1 is a well screen 10 which embodies principles of the present invention. In the following description of the screen 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The screen 10 includes a filter element 12, which is shown in FIG. 1 in its radially compressed pleated configuration. The filter element 12 is generally tubular and is circumferentially pleated, that is, it is folded multiple times circumferentially about its longitudinal axis. In this manner, the filter element 12 circumference as shown in FIG. 1 is substantially smaller than its circumference when it is in an "unpleated" or radially enlarged configuration. As used herein, the term "pleat" is used to include any manner of circumferentially shortening a circumferentially continuous element, and the term "unpleat" is used to include any manner of circumferentially lengthening a previously pleated element.

Figure 2:
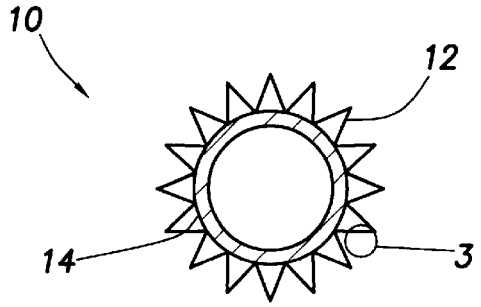
FIG. 2 is a cross-sectional view through the well screen, taken along line 2—2 of FIG. 1.

Referring additionally now to FIG. 2, the screen 10 is shown from a cross-sectional view thereof. In this view, it may be more clearly seen how the filter element 12 is folded so that it is alternately creased and thereby circumferentially shortened. In this view it may also be seen that the filter element 12 radially outwardly overlies an inner generally tubular perforated base pipe 14. The base pipe 14 is optional, since the filter element 12 could be readily utilized in a well without the base pipe. However, use of the base pipe 14 is desirable when its structural rigidity is dictated by well conditions, or when it would be otherwise beneficial to provide additional outward support for the filter element 12.

The base pipe 14 is preferably made of metal and is radially expandable from its configuration shown in FIGS. 1 & 2. Such radial expansion may be accomplished by utilizing any of those conventional methods well known to those skilled in the art. Additional methods are described in the application entitled WELLBORE CASING referred to above. For example, a device commonly known as a "pig" may be forcefully drawn or pushed through the base pipe 14 in order to radially outwardly extend the base pipe's wall.

Note that opposite ends 16 of the base pipe 14 are generally tubular and circumferentially continuous. In this manner, each of the ends 16 may be provided with threads and/or seals, etc. for convenient interconnection of the screen 10 in a tubular string. Specialized expandable end connections are not necessary. Thus, if it is desired to connect the screen 10 to another screen or to a blank (unperforated) tubular section, each end 16 may be connected directly thereto.

The filter element 12 is preferably made of a woven metal material. This material is well adapted for use in a filter element which is folded and unfolded, or otherwise pleated and unpleated, in use. The metal material may also be sintered. However, it is to be clearly understood that other materials, other types of materials, and additional materials may be utilized in construction of the filter element 12 without departing from the principles of the present invention.

Figure 3:
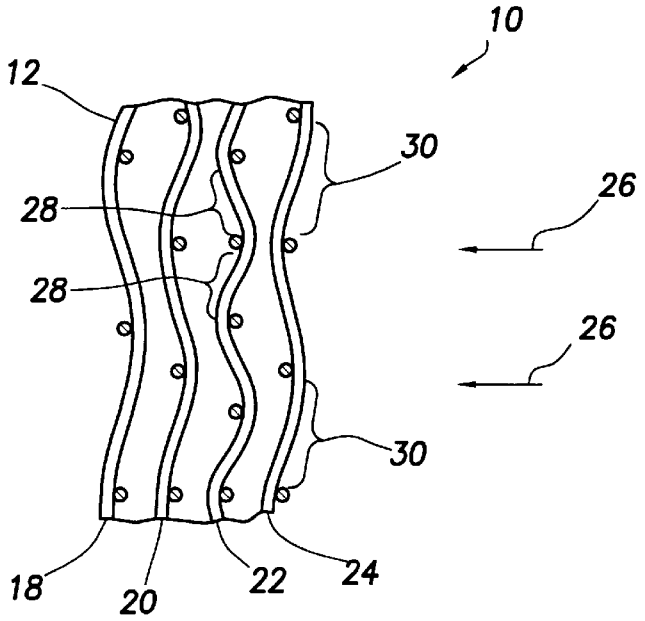
FIG. 3 is an enlarged view of a filter element of the well screen.

Referring additionally to FIG. 3, an enlarged cross-sectional detail of the filter element 12 is representatively illustrated. In FIG. 3 it may be clearly seen that the filter element 12 is made up of multiple layers 18, 20, 22, 24 of woven material. Fluid (indicated by arrows 26) flows inwardly through the layers 18, 20, 22, 24 in the direction shown in FIG. 3 when the screen 10 is utilized in production of fluid from a well. Of course, if the screen 10 is utilized in injection of fluid into a well, the indicated direction of flow of the fluid 26 is reversed.

It will be readily appreciated upon a careful examination of FIG. 3 that layer 22 has openings 28 in its weave that are smaller than those of the other layers 18, 20, 24. Thus, the layer 22 will exclude any particles larger than the openings 28 from the fluid 26 passing inwardly therethrough. The layers 18, 20 inwardly disposed relative to the layer 22 are not necessary, but may be utilized as backup filtering layers in case the layer 22 were to become damaged (e.g., eroded), and may be utilized to provide structural support in the filter element 12.

In one unique feature of the filter element 12, the layer 24 outwardly the inner layer 22 and has openings 30 in its weave which are larger than the openings 28 through the inner layer 22. Thus, the outer layer 24 will allow particles to pass therethrough which will not be permitted to pass through the inner layer 22. However, one of the principle benefits achieved by use of the outer layer 24 is that the inner layer 22 is protected against abrasion, impact, etc. by the outer layer 24 during conveyance, positioning and deployment of the screen 10 in a well.

Figure 4:
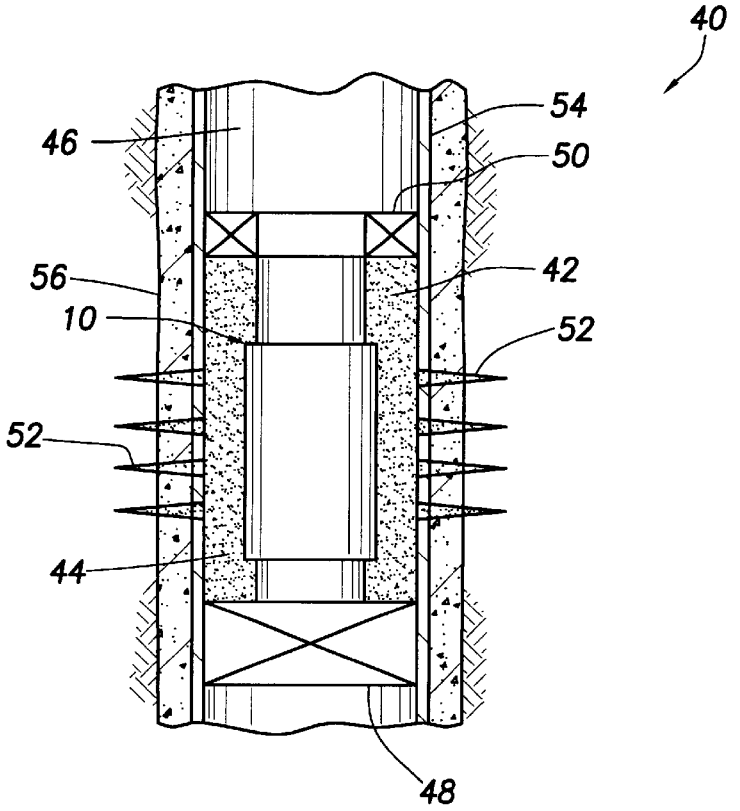
FIG. 4 is a schematicized view of a first method of servicing a subterranean well, the method embodying principles of the present invention.

Referring additionally now to FIG. 4, a method 40 of servicing a subterranean well embodying principles of the present invention is representatively and schematically illustrated. In the method 40, the screen 10 is utilized in a gravel packing operation in which gravel 42 is deposited in an annulus 44 formed between the screen and a wellbore 46 of the well. Methods of depositing the gravel 42 in the annulus 44 about the screen 10 are well known to those skilled in the art and will not be further described herein. However, it is to be clearly understood that a method of servicing a well embodying principles of the present invention may be performed using a variety of techniques for depositing the gravel 42 in the annulus 44 and using a variety of types of gravel (whether naturally occurring or artificially produced).

As shown in FIG. 4, the screen 10 is interconnected between a plug or sump packer 48 and a packer 50. The construction of the screen 10, particularly the configuration of the base pipe 14 as described above, convenient interconnection of the screen. In actual practice, one or more other tubular members may be interconnected between the screen 10 and each of the plug 48 and the packer 50.

Perforations 52 extend outwardly through casing 54 and cement 56 lining the wellbore 46. The screen 10 is positioned in the wellbore 46 opposite the perforations 52. It is not necessary, however, for the screen 10 to be positioned opposite the perforations 52, nor is it necessary for the perforations to exist at all, in keeping with the principles of the present invention, since the method 40 could alternatively be performed in an open hole section of the well.

When the gravel 42 has been deposited in the annulus 44 about the screen 10, the screen is radially expanded from its initial radially reduced configuration to its radially enlarged configuration. Such radial expansion of the screen 10 redistributes the gravel 42 in the annulus 44, for example, causing the gravel to displace upwardly about the screen in the annulus, eliminating voids in the gravel, etc. Additionally, radial expansion of the screen 10 may displace a portion of the gravel 42 into the perforations 52. Note that it is not necessary for the filter element 12 of the screen 10 to be completely unpleated in the method 40.

Referring additionally now to FIG. 5, another method 60 of servicing a subterranean well embodying principles of the present invention is representatively and schematically illustrated. Elements shown in FIG. 5 which are similar to those previously described are indicated in FIG. 5 using the same reference numbers. The screen 10 is depicted interconnected between the plug 48 and the packer 50 in the wellbore 46, but other positionings and interconnections of the screen may be utilized without departing from the principles of the present invention.

In the method 60, sand flow inhibiting particulate matter 62, such as gravel, is deposited in the perforations 52. This operation of depositing the particulate matter 62 in the perforations 52 is commonly referred to as "prepacking" and is well known to those skilled in the art. Therefore, it will not be further described herein. However, it is to be clearly understood that any technique of depositing the particulate matter 62 in the perforations 52 may be utilized without departing from the principles of the present invention.

After the particulate matter 62 has been deposited in the perforations 52, the screen 10 is radially expanded from its initial radially reduced configuration to its radially enlarged configuration as described above. In one unique feature of the method 60, the filter element 12 contacts the inner side surface of the casing 54 adjacent the perforations 52 when the screen 10 is radially expanded.

Referring additionally now to FIG. 6, an enlarged cross-sectional view representatively illustrating the interface between the screen 10 and one of the perforations 52 is shown. In this view it may be clearly seen that the filter element 12 of the screen 10 is in contact with the casing 54 surrounding the illustrated perforation 52. In this manner, the screen 10 in its radially expanded configuration retains the particulate matter 62 within the perforation 52.

It will be readily appreciated by one skilled in the art that the method 60 eliminates the need for depositing gravel 42 (see FIG. 4) in the annulus 44 about the screen 10 for retaining the particulate matter 62 in the perforations 52, since the screen itself retains the particulate matter in the perforations. Note that it is not necessary for the filter element 12 of the screen 10 to be completely unpleated in the method 60.

Of course, many modifications, additions, deletions and other changes to the embodiments described above will be apparent to a person of ordinary skill in the art upon consideration of the above descriptions, and these changes are contemplated by the principles of the present invention. Accordingly, the foregoing detailed description is to be clearly understood as being given by way of illustration and example only, the spirit and scope of the present invention being limited solely by the appended claims.

What is claimed is:

1. An expandable well screen, comprising:

a pleated woven metal filter element, the filter element being radially expanded from a first radially compressed configuration to a second radially enlarged configuration, fluid flow through the well screen being filtered when the filter element is in the second configuration.

2. The screen according to claim 1, wherein the filter element is circumferentially continuous.

3. The screen according to claim 1, further comprising a perforated base pipe disposed within the filter element.

4. The screen according to claim 3, wherein the base pipe has opposite ends, each opposite end being circumferentially continuous and configured for sealing attachment to a tubular member.

5. The screen according to claim 1, wherein the filter element is substantially unpleated when in the second radially expanded configuration.

6. The screen according to claim 1, wherein the filter element includes a first layer of material with first openings therethrough, and a second layer of material with second openings therethrough, the second layer outwardly overlying the first layer, and the second openings being larger than the first openings.

7. A subterranean well system, comprising:

a wellbore intersecting a formation; and a well screen disposed within the wellbore and filtering fluid flowing between the formation and the wellbore, the screen including a woven metal material filter element radially expanded from a first configuration in which the filter element is circumferentally pleated to a second radially enlarged configuration, fluid flow through the well screen being filtered when the filter element is in the second configuration.

8. The well system according to claim 7, wherein the filter element is substantially unpleated in the second radially enlarged configuration.

9. The well system according to claim 7, wherein the filter element includes a first layer of material with first openings therethrough, and a second layer of material with second openings therethrough, the second layer outwardly overlying the first layer, and the second openings being larger than the first openings.

10. The well system according to claim 7, wherein perforations extend into the formation, wherein the perforations have sand flow inhibiting particulate matter disposed therein, and wherein the filter element is positioned adjacent the perforations retaining the particulate matter within the perforations.

11. A subterranean well system, comprising:

a wellbore intersecting a formation; and a well screen disposed within the wellbore and filtering fluid flowing between the formation and the wellbore, the screen including a filter element radially expanded from a first configuration in which the filter element is circumferentially pleated to a second radially enlarged configuration, the screen further including a perforated base pipe disposed within the filter element.

12. A subterranean well system, comprising:

a wellbore intersecting a formation; and a well screen disposed within the wellbore and filtering fluid flowing between the formation and the wellbore, the screen including a filter element radially expanded from a first configuration in which the filter element is circumferentially pleated to a second radially enlarged configuration, the filter element being expanded to the second radially enlarged configuration with gravel in an annulus between the screen and the wellbore, the filter element urging the gravel to displace in the annulus about the screen when the filter element is expanded from the first to the second configuration.

13. A method of servicing a subterranean well, the method comprising the steps of:

conveying a screen into the well, the screen being in a first radially compressed configuration thereof, and the screen including a circumferentially pleated woven metal material filter element;

positioning the screen within the well; and expanding the screen to a second radially enlarged configuration thereof, fluid flow through the screen being filtered when the screen is in the second configuration.

14. The method according to claim 13, wherein in the conveying step, the filter element includes a first layer of material with first openings therethrough, and a second layer of material with second openings therethrough, the second layer outwardly overlying the first layer, and the second openings being larger than the first openings.

15. The method according to claim 13, further comprising the step of disposing sand flow inhibiting particulate matter in perforations extending outwardly into a formation intersected by a wellbore of the well before the expanding step.

16. The method according to claim 15, wherein the expanding step further comprises radially expanding the screen so that it is adjacent the perforations.

17. The method according to claim 16, wherein in the expanding step, the radially expanded screen retains the particulate matter in the perforations.

18. A method of servicing a subterranean well, the method comprising the steps of:

conveying a screen into the well, the screen being in a first radially compressed configuration thereof, the screen including a circumferentially pleated filter element, the screen further including a perforated base pipe disposed within the filter element;

positioning the screen within the well; and expanding the screen to a second radially enlarged configuration thereof.

19. The method according to claim 18, wherein the expanding step further comprises radially enlarging the base pipe.

20. A method of servicing a subterranean well, the method comprising the steps of:

conveying a screen into the well, the screen being in a first radially compressed configuration thereof, the screen including a circumferentially pleated filter element;

positioning the screen within the well; and expanding the screen to a second radially enlarged configuration thereof by radially enlarging the screen within gravel disposed in an annulus formed between the screen and a wellbore of the well, fluid flow through the screen being filtered when the screen is in the second configuration.

21. The method according to claim 20, wherein the expanding step further comprises displacing the gravel in the annulus about the screen by expansion of the screen.

* * * * *